US010433655B1

(12) United States Patent
Hsiao

(10) Patent No.: US 10,433,655 B1
(45) Date of Patent: Oct. 8, 2019

(54) POSITIONING DEVICE FOR A SUPPORTING CLOTH

(71) Applicant: Yun-Cheng Hsiao, Tainan (TW)

(72) Inventor: Yun-Cheng Hsiao, Tainan (TW)

( * ) Notice: Subject to any disclaimer, the term of this patent is extended or adjusted under 35 U.S.C. 154(b) by 0 days.

(21) Appl. No.: 15/981,092

(22) Filed: May 16, 2018

(51) Int. Cl.
*A47C 31/02* (2006.01)
*A47C 7/40* (2006.01)

(52) U.S. Cl.
CPC ..... *A47C 31/023* (2013.01); *A47C 7/40* (2013.01); *A47C 31/026* (2013.01)

(58) Field of Classification Search
CPC ..... A47C 7/40; A47C 31/023; A47C 31/026
USPC ..... 297/452.18, 440.11, 452.38
See application file for complete search history.

(56) References Cited

U.S. PATENT DOCUMENTS

2003/0173815 A1* 9/2003 De Maina ..... B60N 2/7011 297/440.11
2004/0227389 A1* 11/2004 Yoshida ..... B60N 2/64 297/452.18
2004/0262975 A1* 12/2004 Su ..... A47C 5/06 297/440.11
2014/0054947 A1* 2/2014 Su ..... A47C 31/023 297/452.18

* cited by examiner

*Primary Examiner* — Milton Nelson, Jr.

(74) *Attorney, Agent, or Firm* — Birch, Stewart, Kolasch & Birch, LLP

(57) ABSTRACT

A positioning device for a supporting cloth has two first connecting rods and two second connecting rods. The two first connecting rods are respectively disposed on a frame. Each one of the two first connecting rods has two supporting portions formed on two ends of the first connecting rod. The second connecting rods are respectively disposed on the frame and are both adjustably connected to the two first connecting rods to form a ring-like member. A distance between the two second connecting rods is adjustable. Each one of the second connecting rods has two protruding portions respectively formed on the two ends of the connecting rod. The two protruding portions are each inserted into a respective supporting portion. The positioning device is applied to be disposed on the frame for fixing a supporting cloth easily and increasing an elastic support effect of the supporting cloth.

4 Claims, 7 Drawing Sheets

POSITIONING DEVICE FOR A SUPPORTING CLOTH

BACKGROUND OF THE INVENTION

1. Field of the Invention

The present invention relates to a positioning device for a supporting cloth, and more particularly to a positioning device that facilitates ease in assembling the supporting cloth for increasing a supporting effect of the supporting cloth.

2. Description of Related Art

For increasing the comfort of a back of a person reclined on furniture, such as a chair or a bed, a reclining structure of the furniture has a frame and a supporting cloth, and the supporting cloth is fixedly disposed on the frame to provide an elastic support effect. When the person is reclined on the furniture, the supporting cloth of the reclining structure can fit and support the back of the person to increase the comfort.

In a first way of assembly of the reclining structure, the supporting cloth is pulled to open tautly, an outer edge of the supporting cloth is directly fixed on an outer edge of the frame, and the supporting cloth is stretched. The fixing rack is fixedly disposed on the frame, and thus the supporting cloth is indirectly disposed on the fixing rack and is in a tight state. However, tension of the supporting cloth is limited, and the supporting cloth is hard to be pulled to a suitable state in assembly. Therefore, it is difficult to assemble the supporting cloth and the fixing rack.

For decreasing difficulty in assembling the supporting cloth and the fixing rack, another supporting cloth in the form of a pocket is applied, and an opening is formed on an end of the supporting cloth. In a second way of assembly of the reclining structure, the supporting cloth is directly disposed around the frame, and the frame is inserted into the supporting cloth via the opening of the supporting cloth. The opening of the supporting cloth is closed by sewing, zippering, or buttoning. The supporting cloth is disposed around the frame for decreasing the difficulty of the assembly of the reclining structure and increasing the assembly efficiency of the reclining structure. Looseness of the supporting cloth in the second way of assembly of the reclining structure is lesser than that in the first way of assembly of the reclining structure. The elastic support effect provided by the supporting cloth in the second way of assembly of the reclining structure is insufficient.

To overcome the shortcomings, the present invention provides a positioning device for a supporting cloth to mitigate or obviate the aforementioned problems.

SUMMARY OF THE INVENTION

The objective of the invention is to provide a positioning device for a supporting cloth that can solve the drawback that the conventional supporting cloth is difficult to assemble and the elastic support effect provided by the conventional supporting clot is insufficient.

The positioning device for a supporting cloth is applied to be disposed on an inner side of a frame. The positioning device has two first connecting rods and two second connecting rods.

The two first connecting rods are respectively disposed on two opposite inner edges of the frame. Each one of the two first connecting rods has a first body and two supporting portions. The first body has two ends and multiple first through holes. The first through holes are formed through the first body at spaced intervals. The two supporting portions are respectively formed on and protrude out of the two ends of the first body. Each one of the two supporting portions has a side facing the frame and a recess. The recess is formed on the side of the supporting portion.

The second connecting rods are respectively disposed on two opposite inner edges of the frame and are both adjustably connected to the two first connecting rods to form a ring member. A distance between the two second connecting rods is adjustable. Each one of the second connecting rods has a second body and two protruding portions. The second body is located between the two first connecting rods and has two ends and multiple second through holes. The second through holes are formed through the second body at spaced intervals. The two protruding portions are respectively formed on and protrude out of the two ends of the second body, and are each inserted into a respective recess of the two first connecting rods.

The positioning device can be applied to fix a supporting cloth on a frame and has the following advantages:

1. Assembly convenience: The two first connecting rods are both connected to the two second connecting rods for adjusting a distance between the two first connecting rods and the distance between the two second connecting rods. In use, the two first connecting rods are both connected to the two second connecting rods to form the ring member. An external diameter of the ring member is larger than an internal diameter of the frame. An outer edge of the supporting cloth is fixedly disposed on the two first connecting rods and the two second connecting rods. The first connecting rods and the two second connecting rods are disposed on the inner side of the frame. An enclosed area of the ring member is increased. The positioning device is disposed on the frame, and the supporting cloth is stretched and is tautly fixed on the frame simultaneously. Therefore, the assembly convenience and the assembly efficiency in fixing the supporting cloth on the frame are increased.

2. Elastic support effect: As mentioned above, the supporting cloth is stretched and is tautly fixed on the frame by the positioning device. The elastic support effect provided by the supporting cloth is increased for supporting a back of a person reclined on the supporting cloth.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
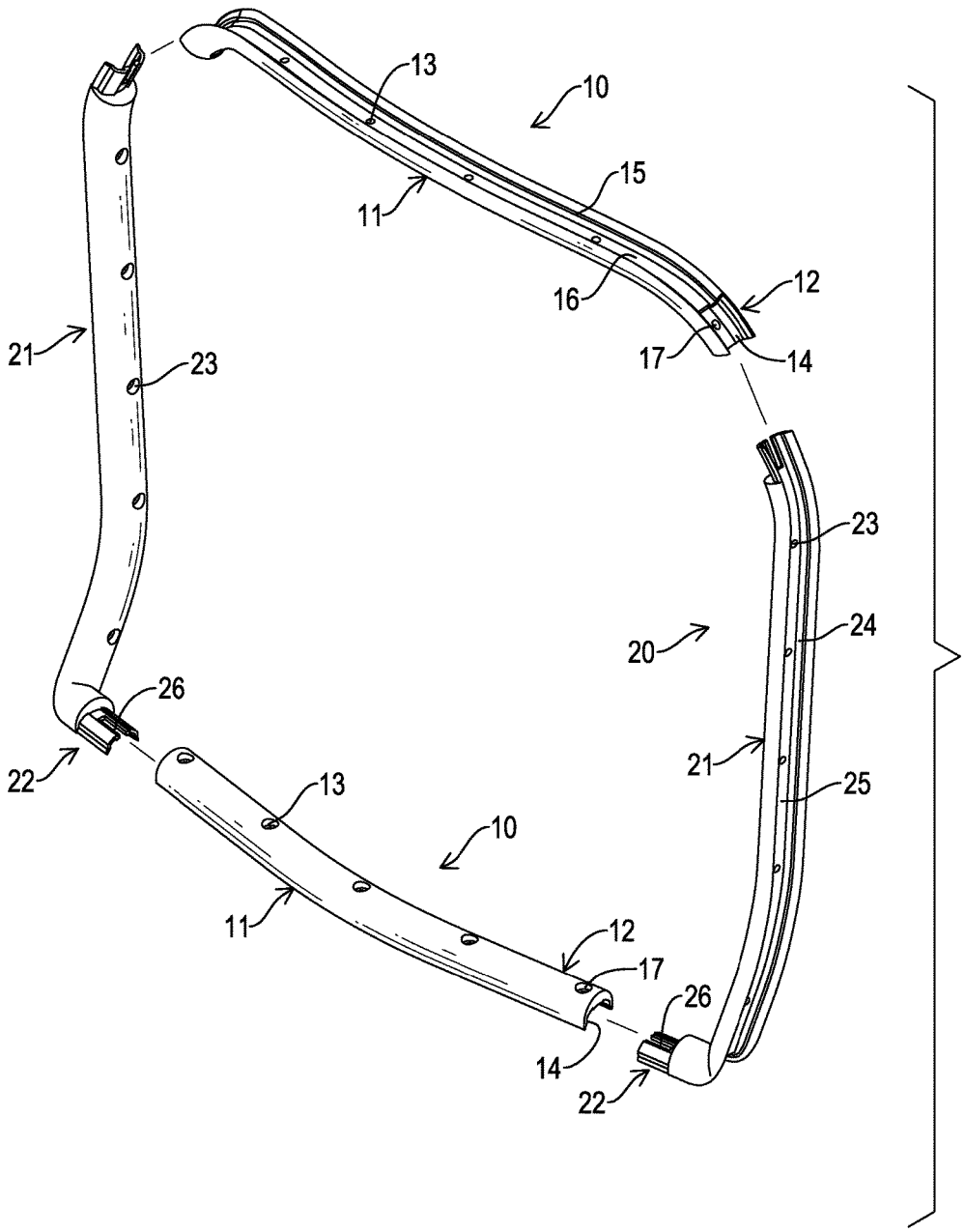
FIG. 1 is an exploded perspective view of a positioning device for a supporting cloth in accordance with the present invention.
Figure 2:
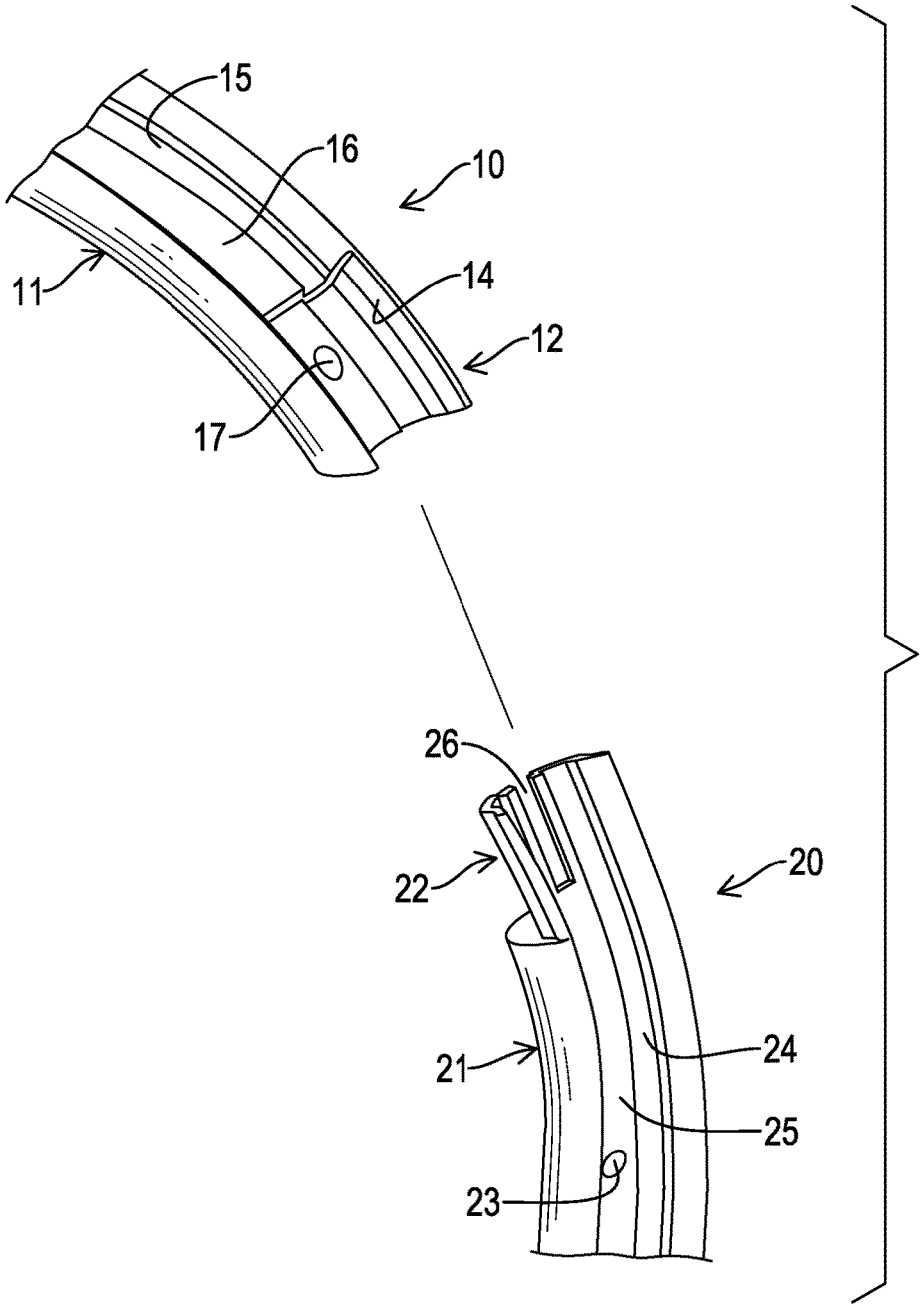
FIG. 2 is an enlarged exploded perspective view of the positioning device in FIG. 1.
Figure 3:
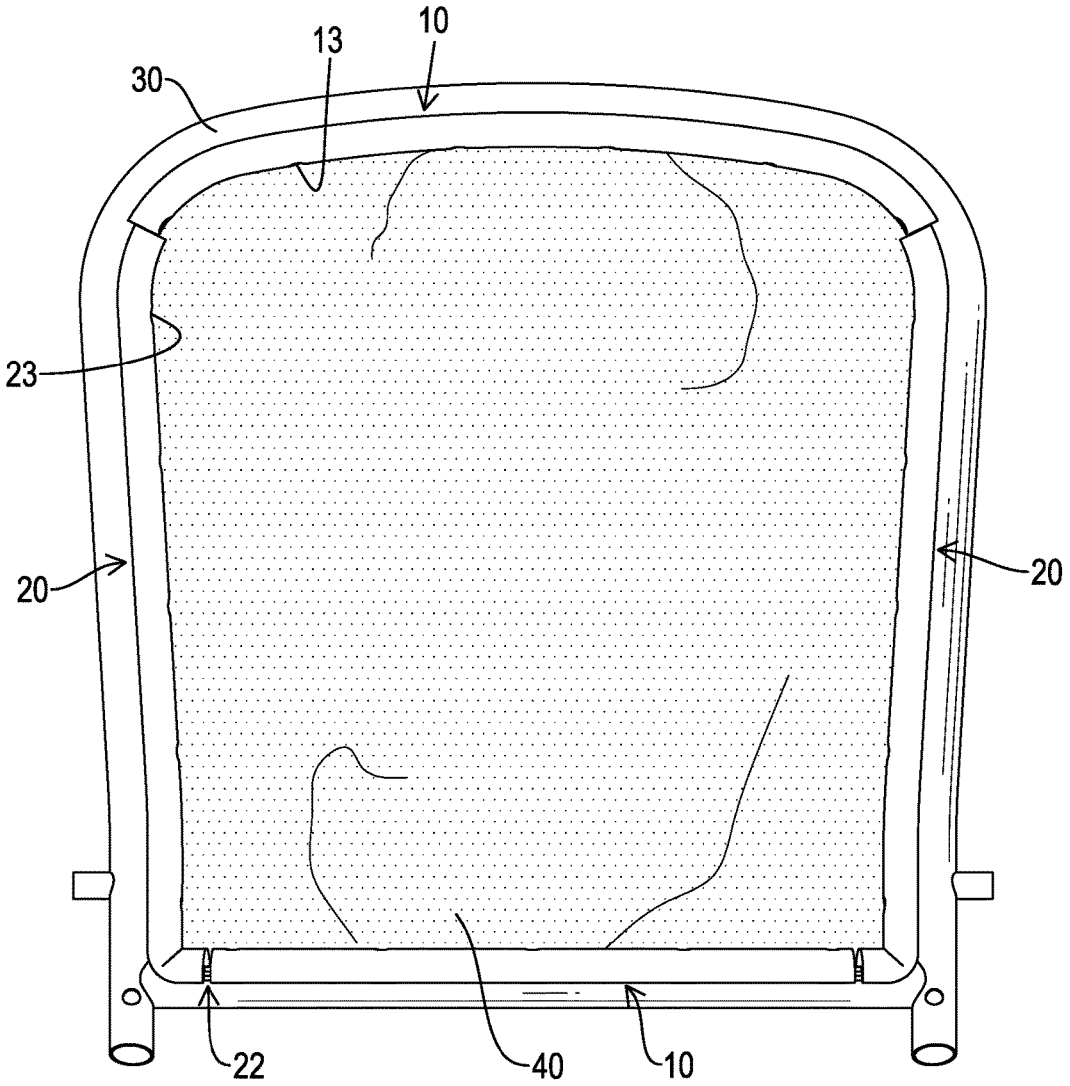
FIG. 3 is an operational rear side view of the positioning device in FIG. 1, showing a supporting cloth is disposed on the positioning device and the positioning device is located in a frame.

With reference to FIGS. 1 to 3, a positioning device for a supporting cloth in accordance with the present invention is applied to be disposed on an inner side of a frame 30, and the positioning device has two first connecting rods 10 and two second connecting rods 20.

With reference to FIGS. 1 to 3, the two first connecting rods 10 are respectively disposed on two opposite inner edges of the frame 30. Each one of the two first connecting rods 10 has a first body 11 and two supporting portions 12. The first body 11 has two ends and multiple first through holes 13. The first through holes 13 are formed through the first body 11 at spaced intervals. The two supporting portions 12 are respectively formed on and protrude out of the two ends of the first body 11. Each one of the two supporting portions 12 has a side facing the frame 30 and a recess 14. The recess 14 is formed on the side of the supporting portion 12.

The second connecting rods 20 are respectively disposed on the two opposite inner edges of the frame 30 and are both adjustably connected to the two first connecting rods 10 to form a ring member. A distance between the two second connecting rods 20 is adjustable. Each one of the second connecting rods 20 has a second body 21 and two protruding portions 22. The second body 21 is located between the two first connecting rods 10 and has two ends and multiple second through holes 23. The second through holes 23 are formed through the second body 21 at spaced intervals. The two protruding portions 22 are respectively formed on and protrude out of the two ends of the second body 21, and are each inserted into a respective recess 14 of the two first connecting rods 10.

Each one of the first connecting rods 10 has a side facing the frame 30, a first connecting groove 15, and a first protrusion 16. The first connecting groove 15 is formed on the side of the first connecting rod 10 and is connected to the recesses 14 of the two supporting portions 12 of the first connecting rod 10. The first protrusion 16 is formed on the side of the first connecting rod 10 and is protruded into the first connecting groove 15. The first through holes 13 are formed through the first protrusion 16 and are in communication with the first connecting groove 15. Each one of the second connecting rods 20 has a side facing the frame 30, a second connecting groove 24, and a second protrusion 25. The second connecting groove 24 is formed on the side of the second connecting rod 20. The second protrusion 25 is formed on the side of the second connecting rod 20 and is protruded into the second connecting groove 24. The second through holes 23 are formed through the second protrusion 25 and are in communication with the second connecting groove 24.

Furthermore, in each one of the two first connecting rods 10, each one of the two supporting portions 12 has a locking hole 17. The locking hole 17 is formed through the supporting portion 12 and is connected to the recess 14. In each one of the two second connecting rods 20, each one of the two protruding portions 22 has a guiding groove 26. The guiding groove 26 is elongate and is formed through the protruding portion 22.

With reference to FIG. 3, a supporting cloth 40 is fixed on the positioning device, and then the supporting cloth 40 can be disposed on the frame 30 by the positioning device. The shape of the ring member assembled by the two first connecting rods 10 and the two second connecting rods 20 is similar to the shape of the frame 30.

Figure 4:
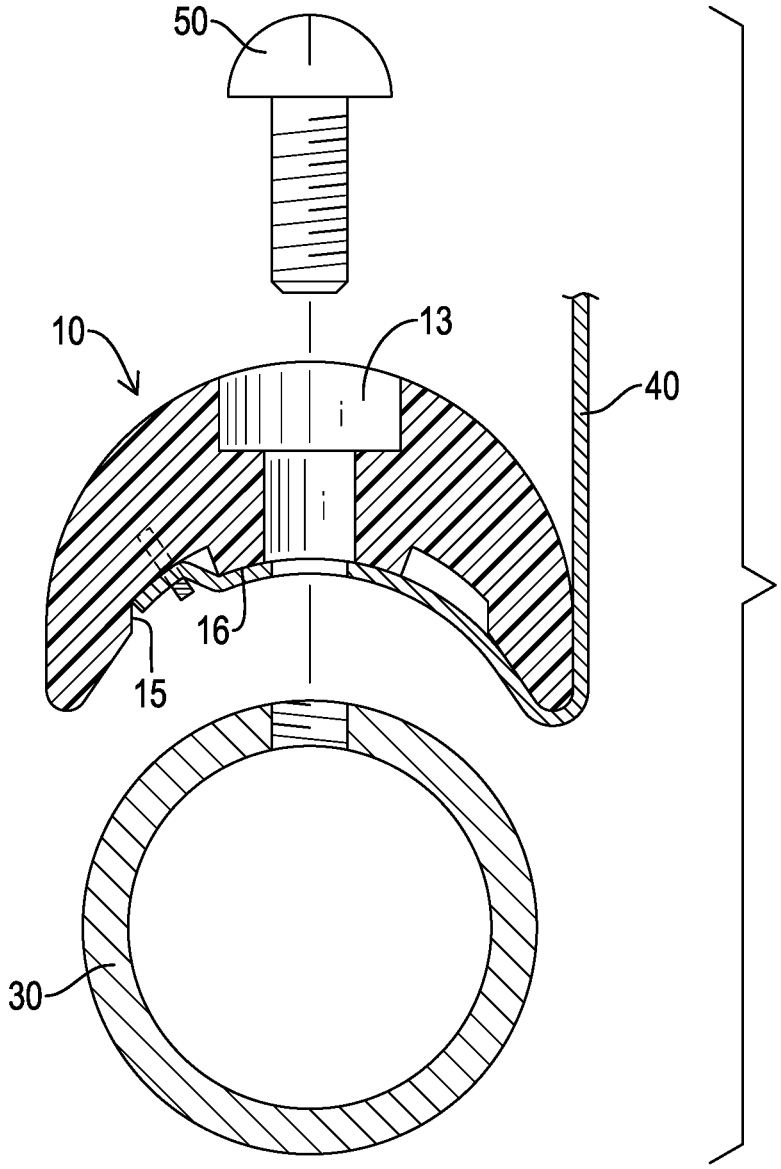
FIG. 4 is an operational rear side view in partial section of the positioning device in FIG. 3.

With reference to FIGS. 3 and 4, in use, the two first connecting rods 10 are both connected to the two second connecting rods 20 to form the ring member. The protruding portions 22 of the two second connecting rods 20 are inserted into the recesses 14 of the first connecting rods 10. An external diameter of the ring member is larger than an internal diameter of the frame 30.

Figure 5:
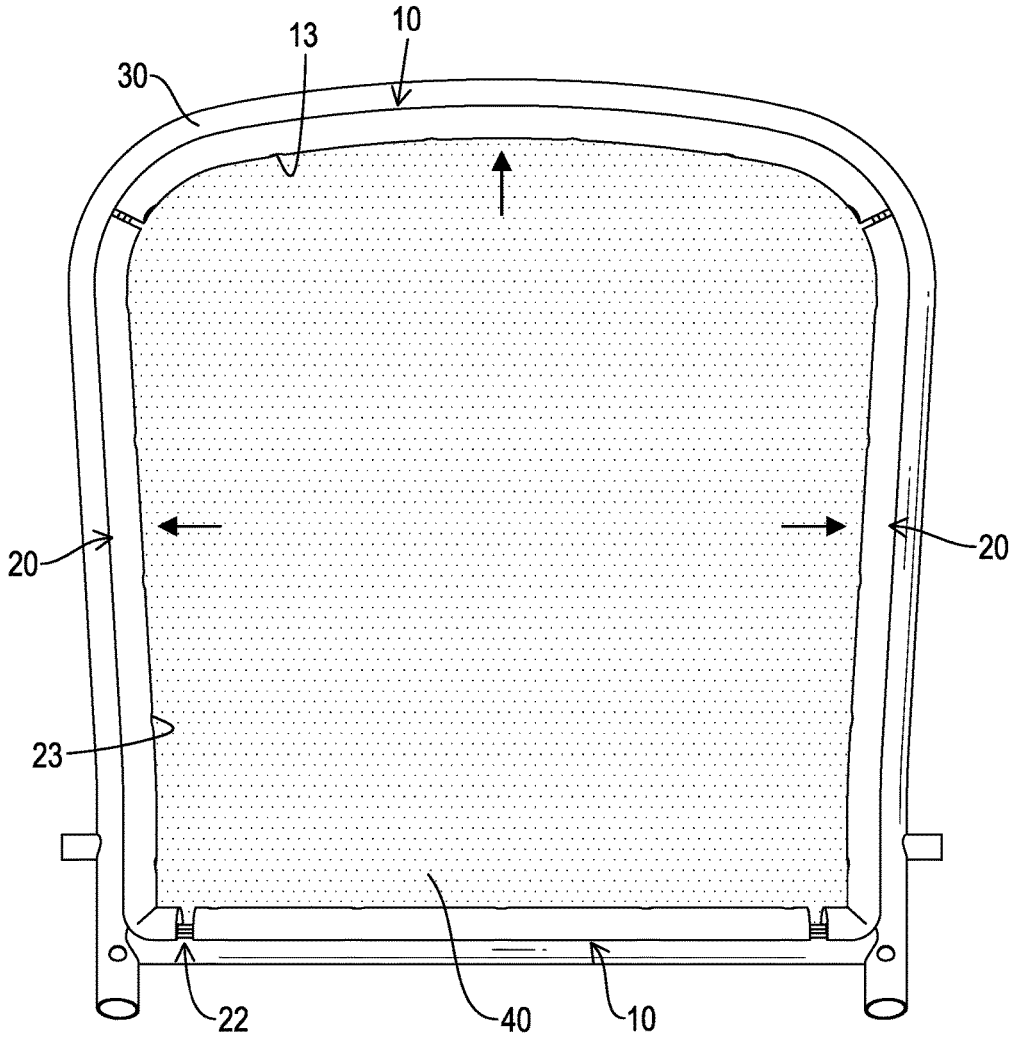
FIG. 5 is another operational rear side view of the positioning device in FIG. 1, showing the positioning device is disposed on the frame.
Figure 6:
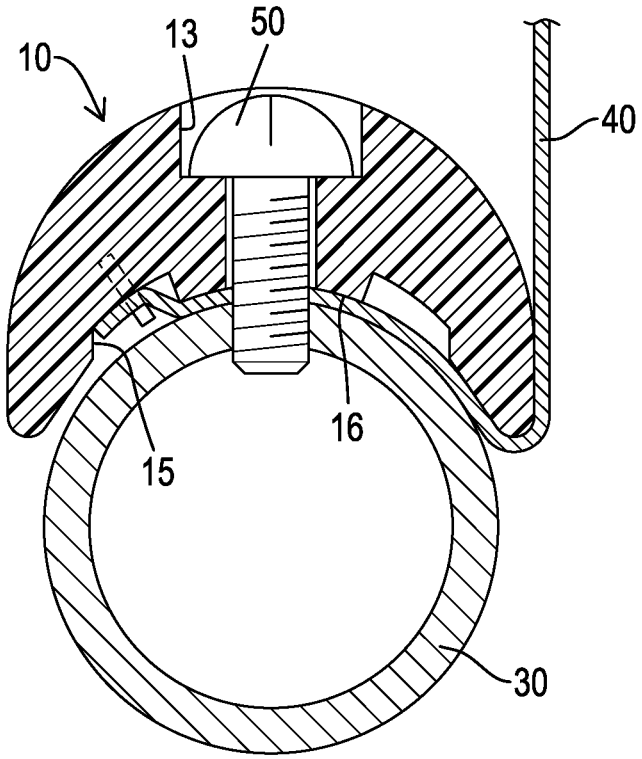
FIG. 6 is another operational rear side view in partial section of the positioning device in FIG. 5.
Figure 7:
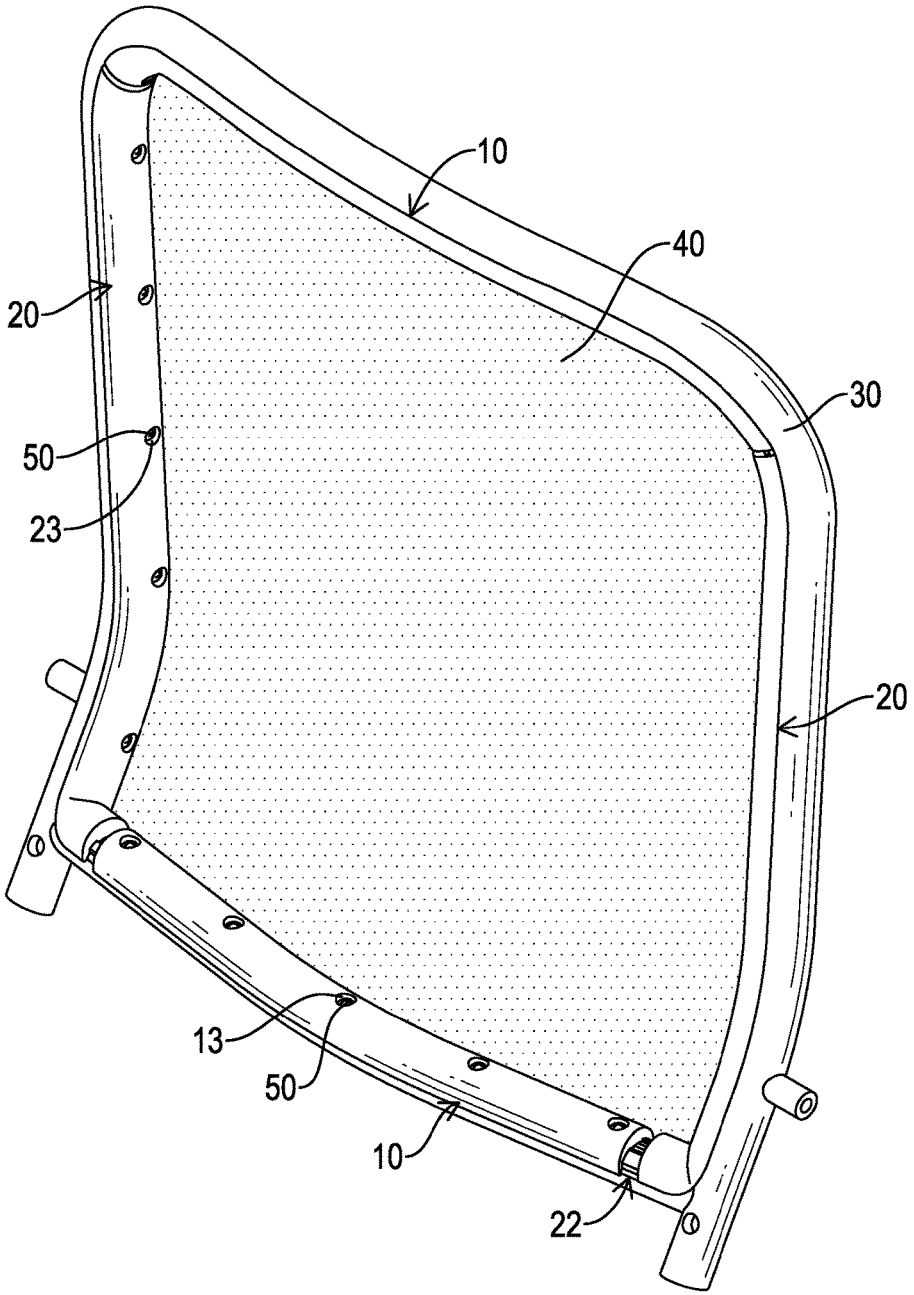
FIG. 7 is an operational perspective view of the positioning device in FIG. 5.

An outer edge of the supporting cloth 40 is fixedly disposed in the first connecting grooves 15 of the two first connecting rods 10 and the second connecting grooves 24 of the two second connecting rods 20. Then, the supporting cloth 40 can be disposed on the inner side of the frame 30 by the positioning device. With reference to FIGS. 5 to 7, multiple fasteners 50 are respectively inserted into the first through holes 13 of the two first connecting rods 10, the locking holes 17, and the second through holes 23 of the two second connecting rods 20 for fixing the positioning device on the frame 30. The protruding portions 22 of the two second connecting rods 20 can outwardly move along the recesses 14 of the two first connecting rods 10 for increasing an enclosed area of the ring member. The supporting cloth 40 can be stretched tautly.

With reference to FIGS. 5 and 6, when the two first connecting rods 10 and the two second connecting rods 20 are disposed on the frame 30, the fasteners 50 can be screwed and drive the two first connecting rods 10 and the two second connecting rods 20 to move toward the frame 30 for increasing the enclosed area of the ring member. Therefore, the supporting cloth 40 is stretched gradually and tautly. The supporting cloth 40 is fixedly disposed on the frame 30 by the positioning device in a taut state. An elastic support effect provided by the supporting cloth 40 is increased for supporting a back of a person reclined on the supporting cloth 40.

Furthermore, with reference to FIG. 6, when the positioning device is disposed on the frame 30, the outer edge of the supporting cloth 40 abuts against the inner side of the frame 30 by the first protrusions 16 of the two first connecting rods 10 and the second protrusions 25 of the two second connecting rods 20 for increasing a fixing effect of the supporting cloth 40.

In addition, when the two first connecting rods 10 and the two second connecting rods 20 are fixedly disposed on the inner side of the frame 30 by the fasteners 50, part of the fasteners 50 inserted through the locking holes 17 can move along the guiding grooves 26 of the protruding portions 22.

Accordingly, a distance between the two first connecting rods 10 can be adjusted, and a distance between the two second connecting rods 20 can be adjusted, too. The positioning device is disposed on the frame 30. The supporting cloth 40 can be stretched and is tautly fixed on the frame 30, simultaneously. Therefore, the assembly convenience and the assembly efficiency in fixing the supporting cloth 40 on the frame 30 are increased. The elastic support effect provided by the supporting cloth 40 is increased, too.

What is claimed is:

1. A positioning device for a supporting cloth being applied to be disposed on an inner side of a frame, the positioning device comprising:

two first connecting rods respectively disposed on two opposite inner edges of the frame, and each one of the two first connecting rods having a first body having two ends; and multiple first through holes formed through the first body at spaced intervals; and two supporting portions respectively formed on and protruding out of the two ends of the first body, and each one of the two supporting portions having a side facing the frame and a recess, and the recess formed on the side of the supporting portion; and two second connecting rods respectively disposed on two opposite inner edges of the frame, and the two second connecting rods adjustably connected to the two first connecting rods to form a ring member, wherein a distance between the two second connecting rods is adjustable, and each one of the second connecting rods having a second body located between the two first connecting rods and having two ends; and multiple second through holes formed through the second body at spaced intervals; and two protruding portions respectively formed on and protruding out of the two ends of the second body, and each protruding portion inserted into a respective one of the recesses of the two first connecting rods.

2. The positioning device as claimed in claim 1, wherein in each one of the two first connecting rods, each one of the two supporting portions has a locking hole, the locking hole is formed through the supporting portion and is connected to the recess, and in each one of the two second connecting rods, each one of the two protruding portions has a guiding groove, and the guiding groove is elongate and is formed through the protruding portion.

3. The positioning device as claimed in claim 1, wherein each one of the first connecting rods has a side facing the frame;

a first connecting groove formed on the side of the first connecting rod and connected to the recesses of the two supporting portions of the first connecting rod;

a first protrusion formed on the side of the first connecting rod and protruding into the first connecting groove; and the first through holes formed through the first protrusion and communicating with the first connecting groove; and each one of the second connecting rods has a side facing the frame;

a second connecting groove formed on the side of the second connecting rod;

a second protrusion formed on the side of the second connecting rod and protruding into the second connecting groove; and the second through holes formed through the second protrusion and communicating with the second connecting groove.

4. The positioning device as claimed in claim 3, wherein in each one of the two first connecting rods, each one of the two supporting portions has a locking hole, the locking hole is formed through the supporting portion and is connected to the recess, and in each one of the two second connecting rods, each one of the two protruding portions has a guiding groove, and the guiding groove is elongate and is formed through the protruding portion.

* * * * *